United States Patent [19]

Korff

[11] Patent Number: 4,899,928

[45] Date of Patent: Feb. 13, 1990

[54] DRAWING STORAGE CABINET DRAWER DIVIDER

[76] Inventor: W. G. Korff, 12153 Gerald Ave., Granada Hills, Calif. 91344

[21] Appl. No.: 314,759

[22] Filed: Jan. 17, 1989

[51] Int. Cl.[4] ..... B65D 5/48

[52] U.S. Cl. ..... 229/120.36; 220/22.3; 229/913; 312/261; 312/330 SM

[58] Field of Search ..... 229/120.25, 120.34, 229/120.36, 120.37, 120.38, 913; 220/22.1, 22.2, 22.3; 312/259, 261, 330 R, 330 SM; 217/30–32

[56] References Cited

U.S. PATENT DOCUMENTS

| | | | |
|---|---|---|---|
| 1,345,711 | 7/1920 | Shapiro | 229/120.37 |
| 2,647,679 | 8/1953 | Schilling et al. | 229/120.36 |
| 3,494,685 | 2/1970 | Fiterman et al. | 312/261 |
| 4,062,166 | 12/1977 | Debaigt | 217/31 |
| 4,065,021 | 12/1977 | Kedzierski | 229/120.25 |
| 4,255,039 | 9/1980 | Skaggs | 229/120.25 |
| 4,429,932 | 2/1984 | Brennan | 229/120.36 |
| 4,437,713 | 3/1984 | Roach | 312/261 |

FOREIGN PATENT DOCUMENTS

| | | | |
|---|---|---|---|
| 1575372 | 9/1980 | United Kingdom | 229/120.34 |

*Primary Examiner*—Gary Elkins

[57] ABSTRACT

A divider for drawers which has a flat base (20) with folded sides (22) forming a rectangular pan. A center separation (30) folded in the middle in "U" shape is inserted snugly into the base sub-dividing the area. A pair of partitions (40) further apportion the divider allowing different size original drawings to be filed concurrently within the drawer of a storage cabinet. The configuration allowing bisection of the drawer such that conventionally sized drawings may be organized into groups. Also, different configurations are obtained by the addition or deletion of component parts.

8 Claims, 3 Drawing Sheets

40
22
34
30
32
20
40
40
42
42
42
42
42

34
36
30
44
32
44
44
36

44
38
44
44
20
22

DRAWING STORAGE CABINET DRAWER DIVIDER

TECHNICAL FIELD

The present invention relates to drawer dividers in general, and more specifically to dividers for flat storage cabinets in which drawing masters are filed.

BACKGROUND ART

Previously, many types of compartmentalized dividers have been used in endeavoring to provide an effective means for organizing a given space into smaller workable areas. Prior art is replete with structure utilizing individual dividers attached by tabs on the members interfacing with slots within a larger tray or enclosure.

A search of the prior art did not disclose any patents that read directly on the claims of the instant invention, however, the following U.S. Patents were considered related:

| U.S. Pat. No. | Inventor | Issue Date |
|---|---|---|
| 4,362,251 | Marling | Dec. 7, 1982 |
| 2,888,160 | Sitler | May 26, 1959 |
| 2,788,912 | Simonsen | Apr. 16, 1957 |

Marling teaches a space dividing assembly with grooves formed into the major oppositely facing surfaces with flexible rails that extend into the grooves and form channels which lock together Connecting members attach the partitions together to form the space dividing assembly The connecting members are engaged entirely within the grooves forming an integral divider.

Sitler discloses a tray construction having a bottom with upturned opposed peripheral flanges with a set of guides and a slot in between. Each slot intersects a divider having tabs thereon and shoulders wedge against the slot edge to lock them into place. Sitler also uses an intermediate tab, also with shoulders that bear against the edges to interlock the end of the divider.

Simonsen employs a receptacle formed into a tray with a flat bottom and vertical sides. The sides have elongate vertical slots through which partitions with tabs are placed. The resilient nature of the tray allows the partitions to be forced into the slots fitting snugly when installed therein.

DISCLOSURE OF THE INVENTION

Specifically, the invention deals with dividers for flat drawing files of the type used by engineers, architects, artists and others for filing vellum masters and other important documents in an orderly manner, by separating the file drawers into combinations of properly sized subsections.

Typical commercially available file drawers have the following inside dimensions.

| Depth | Width | Height |
|---|---|---|
| 26.0 in. (66.0) | 37 in. (94.0) | 2 in. (5.1) |
| 38.5 in. (97.8) | 50 in. (127.0) | 2 in. (5.1) |
| 51.0 in. (129.5) | 78 in. (198.1) | 2 in. (5.1) |

If such drawers were to be used only for filing drawings which are just slightly smaller than the inside dimensions of the drawer, it would be easy to maintain them in an orderly state. However, in many cases, the drawers are used for drawings of varying size, such as:

| | | |
|---|---|---|
| Engineering Format: | | |
| 8½ × 11 in. | (A-Size) | (21.6 × 27.9 cm) |
| 11 × 17 in. | (B-Size) | (27.9 × 43.2 cm) |
| 17 × 22 in. | (C-Size) | (43.2 × 55.9 cm) |
| 22 × 34 in. | (D-Size) | (55.9 × 86.4 cm) |
| Architectural Format: | | |
| 9 × 12 in. | (A-Size) | (22.9 × 30.5 cm) |
| 12 × 18 in. | (B-Size) | (30.5 × 45.7 cm) |
| 18 × 24 in. | (C-Size) | (45.7 × 61.0 cm) |
| 24 × 36 in. | (D-Size) | (61.0 × 91.4 cm) |

In an ideal filing set-up, the drawings or other documents are usually organized in main groups and subgroups. For example, the main group may be: ALL documents common to a particular entity, such as a certain equipment model, or a certain building. Depending on the complexity of the entity, such main groups of documents may consist of drawings, parts lists, bills of material, assembly instructions, manuals, etc., and may take up one or several file drawers of the sizes listed above.

The sub-groups may be comprised of sub-assemblies or other divisions of the main entity, such as:

| Sub-Group: | Main Group: |
|---|---|
| Transmission | Automobile |
| Carburetor | Automobile |
| Mechanical Parts | Packing Machine |
| Electrical Diagrams | Packing Machine |
| Plumbing Details | Office Building "A" |
| Specifications | Office Building "A" |

As can be seen, the final filing set-up may include main groups occupying a small number of drawers, each containing a multiplicity of sub-groups.

Large main groups may occupy many drawers, each dedicated to only a single sub-group.

Regardless of the structure of organization, the filing set-up is made more difficult by the fact that the above documents can be of any one of the available sizes shown above. This means that several groups of different size documents will have to be filed together in the same drawer.

When a multiplicity of such documents is filed in a large drawer, it is not possible to maintain them in neatly separated stacks without some type of separating divider. Repeated opening and closing of the drawer will cause the documents to slide around uncontrollably and thus come into disarray. Additional problems are caused by the absence of separating dividers when one must leaf through the various stacks in search of a particular document, or a combination of different sizes.

Manufacturers of flat file drawing cabinets typically offer sets of file dividers as optional accessories. These are generally comprised of sheet metal or plastic ribs having an L- or T-shaped cross-section. The bottom horizontal legs of the ribs are provided with a series of holes, permitting them to be bolted to the inside surface of the drawers.

This method is characterized by several problems:

1. The drawers have to be removed from the cabinet in order to gain access to their underside for the insertion and tightening of fasteners.

2. Length and quantity of ribs provided may limit the size and quantity of bins that can be constructed from them to such an extent that it may be impossible to create bins of suitable size for some of the standard size documents to be filed.
3. Likewise, the hole pattern provided in the bottom of the drawers may limit the size and quantity of bins that can be constructed to fit them to such an extent that it may be impossible to create bins of a suitable size.
4. The assembly process is quite time consuming and, once completed, not easily rearranged into different sizes.
5. The bottom-most documents, due to their thickness, may slide into the gap which is formed between the divider and the drawer bottom, at times even protruding into adjacent bins, thus causing difficulty and possible damage during retrieval.

Other types of commercially available dividers may differ from the foregoing in material, cross-section, and/or method of fastening. For example, some employ the use of adhesive in lieu of bolting. While this reduces assembly time and eliminates the need for removal of the drawers, it requires skill to properly locate the parts, and prohibits future rearrangement of the bins into other size combinations.

Another solution has been the installation of wooden dividers, fastened to the drawer bottom with wood screws. This design is also cumbersome, relatively expensive, and not easily converted into other size combinations.

One notable result of these shortcomings has been to entirely forego the use of such dividers, due to their being impractical, and to simply tolerate the disarray of the drawings resulting from loose stacking.

Another solution has been to pack designated stacks of drawings, parts lists, or other documents, into assorted sizes of paper bags for separating purposes. While this will avoid the mixing of documents from different stacks, it greatly hampers access for searching and for fast retrieval of individual documents.

With the above in mind, it is a primary object of the invention to provide a single size divider that will fit any common size drawer, whether it is constructed of metal, wood or cardboard, with or without punched holes in the bottom, and may be installed by unskilled personnel without the use of any tools whatsoever and without the need to remove the drawers by simply inserting the device into each drawer.

An important object of the invention allows the device to be assembled to form any desired combination of bin size or quantity, to accommodate any of the standard drawing sizes in separate stacks within a drawer. The preferred embodiment is sized to fit both the Engineering, as well as the Architectural, drawing sizes By simply using the appropriate dimensions, it is, of course, possible to utilize the same principle for other national or international standards.

Another object of the invention is that it makes good use of the drawer space which remains unoccupied once the device is installed. In the case of all standard large size drawers, this remaining space actually forms the bin for the largest documents to be accommodated within the drawer.

For example, if the drawer size is 38.5 in.×50 in. (97.8×127 cm), two dividers will take up exactly 50 percent of the total drawer space, see FIG. 8. The dividers themselves can be set up to accommodate:

1 stack 8½×11 in. (21.6×27.9 cm) (A-size)
1 stack 9×12 in. (22.9×30.5 cm) (A-size)
1 stack 11×17 in. (27.9×43.2 cm) (B-size) or 12×18 in. (30.5×45.7 cm)
1 stack 18×24 in. (45.7×61.0 cm) (C-size) or 17×22 in. (43.2×55.9 cm)

The remaining 50 percent of drawer space forms a perfect bin for: 1 stack 22×34 in. (53.9×86.4 cm) or 24×36 in. (61.0×91.4 cm) also known as D-size, thus accommodating the majority of drawing sizes used. In those cases where even larger drawings are used, it is, of course, a simple matter of making a divider having correspondingly larger dimensions, to accommodate such drawings as well, without departing from the spirit of the invention.

Still another object of the invention is its ease of assembly requiring no tools or skillful placement procedure, and with its fabrication out of a relatively inexpensive material, such as cardboard, the entire assembly is cost effective.

Yet another object of the invention allows easy rearrangement into combinations of bin sizes and quantities that allow reliable retrieval of all of the documents, which may be removed with groupings intact as a whole for reassignment into other drawers or files.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figures 1, 2:
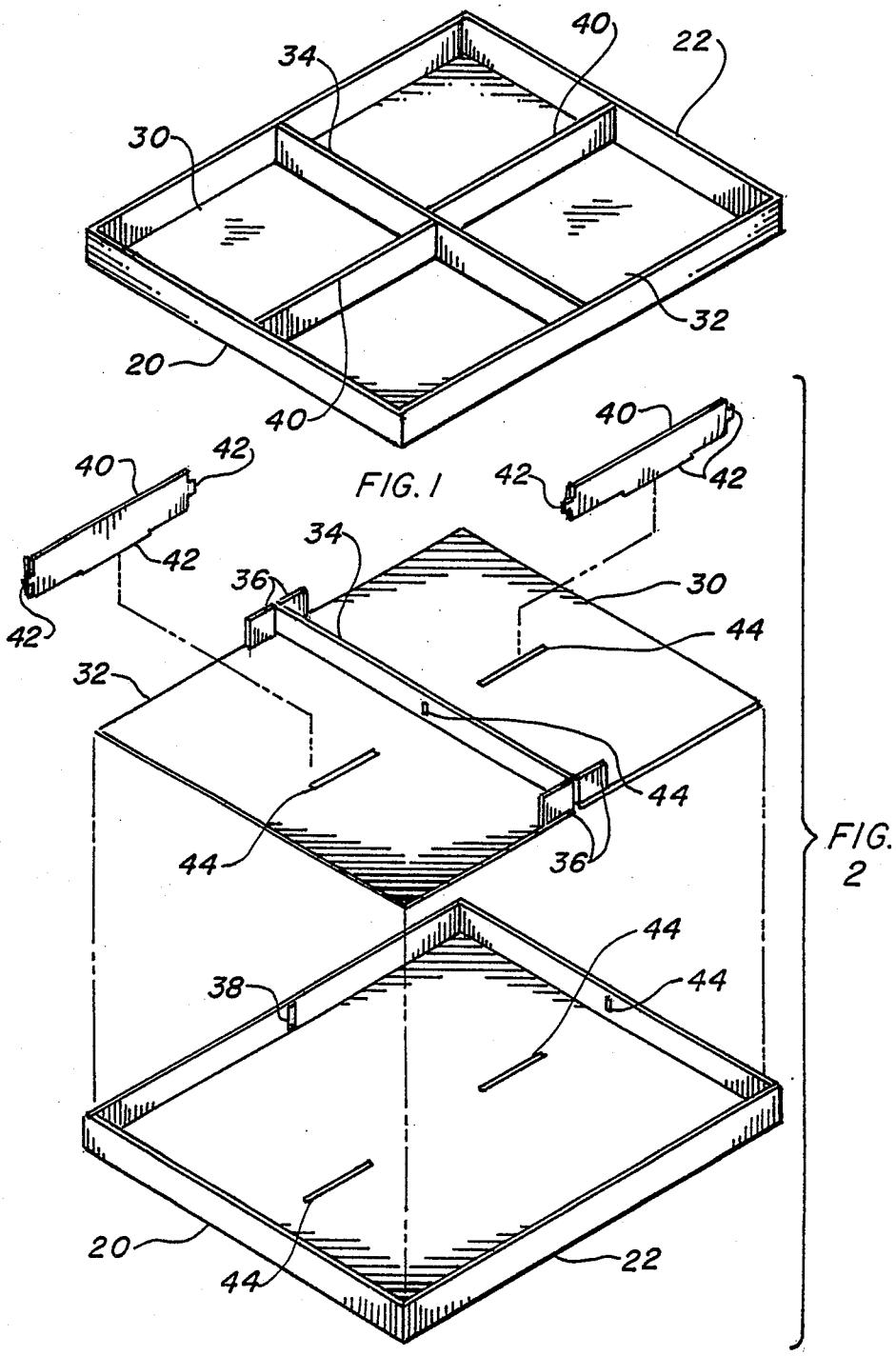
FIG. 1 is a partial isometric view of the preferred embodiment completely assembled and ready for installation into a file drawer.
FIG. 2 is an exploded view of the invention with lines depicting the location as removed thereabove.

The best mode for carrying out the invention is presented in terms of a preferred embodiment. The preferred embodiment, as shown in FIGS. 1 through 9 is comprised of a flat base 20 with all four outside borders folded into equal height sides 22. These sides 22 are formed upward, inward and down, into an interlocking junction with a plurality of tabs 24 distending integrally from the periphery of the base sides 22. These male tabs 24 mate into female slots 26 in the base 20 that are in direct alignment therewith, making a positive junction when the tabs 24 are inserted snugly into the slots 26. The number of tabs 24 and mating slots 26 may vary, however, it has been found that three on each side has proven optimum to create a solid unyielding structure.

Figure 3:
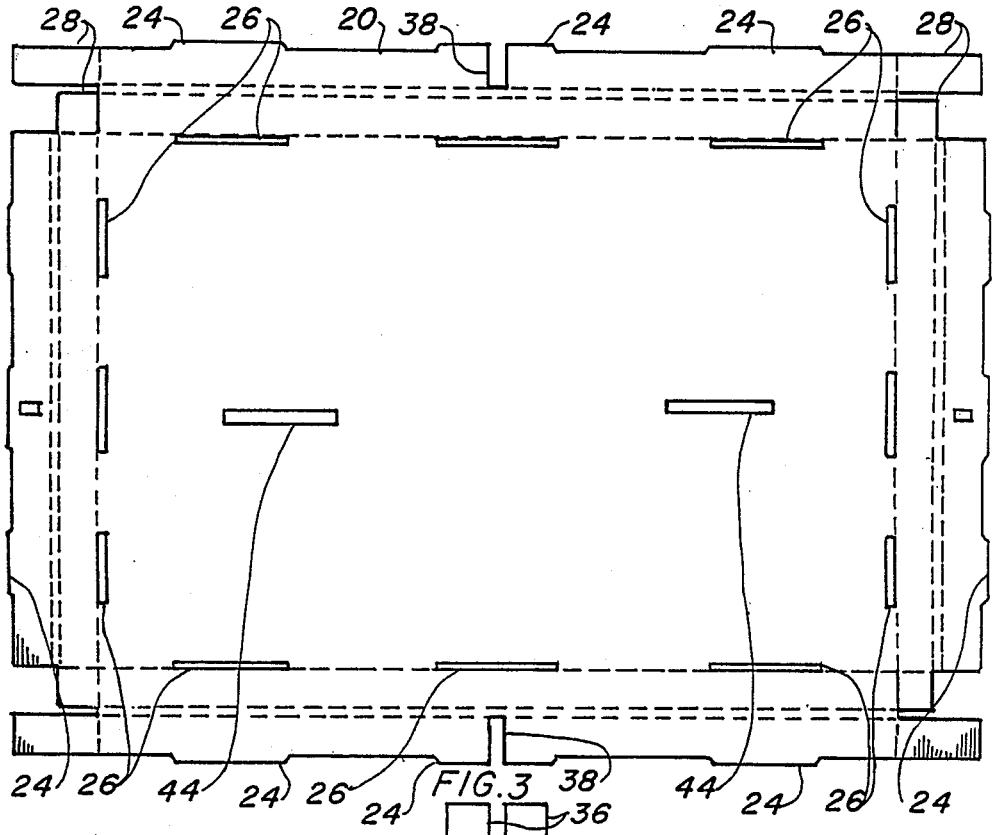
FIG. 3 is a plan view of the base in the flat before it has been folded. The dashed lines indicate the fold marks.

In order to maintain the integrity of the corners, the upwardly and downwardly depending sides 22 have flaps 28 extending on opposite sides, as illustrated in the flat in FIG. 3. These flaps 28 are inserted between the alternate upward and downward sides forming a structural corner with each flap 28 inserted into alternate directions, thereby interlocking the corners into an integral folded junction having sufficient integrity to maintain the integrity of the corners.

A center separation 30 is formed with a flat subbase 32 approximately the same size as the inside of the base 20 with a raised central portion 34 in "U" shape, allowing a snug fit when positioned within the base 20. The top of the central portion 34 is planar with the sides 22, allowing the height of the assembly to be the same on the edges and in the middle. The subbase 32 is contiguous with the inside of the base 20, providing a double thickness of structure in the flat inside portion and as it fits tightly, the base 20 is structurally reinforced.

Figure 4:
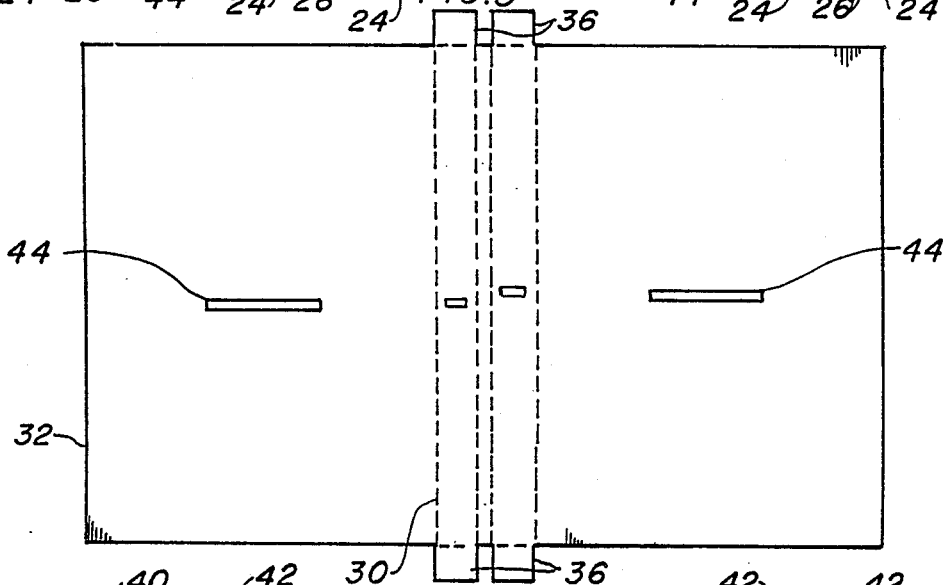
FIG. 4 is a plan view of the center separation in the flat before the center section has been folded into a "U" shape. The dashed lines indicate the fold marks.
Figure 5:
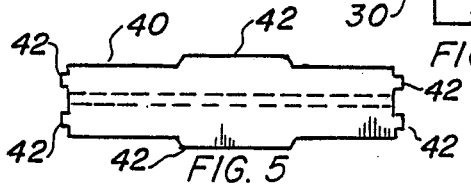
FIG. 5 is a plan view of the first partition in the flat before it has been folded. The dashed lines indicate the fold marks.
Figure 6:
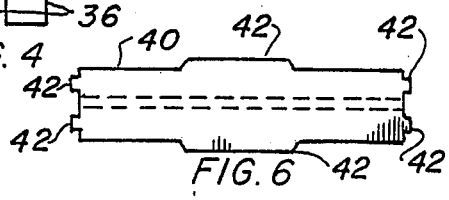
FIG. 6 is a plan view of the second partition in the flat before it has been folded. The dashed lines indicate the fold marks.

The center separation 30 further contains a pair of ears 36 protruding outwardly from the upwardly extending central portion 34, best shown in FIG. 4. The sides 22 of the base 20 also contain a mating pair of slits 38 that are aligned adjacent to the central portion 34 of the sub-base 32 when it is inserted therein. In assembly, the ears 36 are inserted in opposite directions into the slits 38 between the upwardly and downwardly formed sides 22. This junction holds the center separation 30 in place at the central portion 34, and the snug fit of the sub-base 32 against the sides 22 maintains the structural relationship of both elements. Further, the added thickness of the center separation 30 butts against the sides 22, further maintaining the tabs 24 into the slots 26.

A plurality of partitions 40 are formed in "U" shape the same height as the central portion 34 of the center separation 30, and of the length matching the distance between upwardly formed central portion 34 and the base sides 22 when the elements are joined together. The partitions 40 further contain an extended lip 42 on both ends and on the bottom, illustrated in the flat in FIGS. 5 and 6 and folded into "U" shape in FIG. 2. The base 20, in both the bottom and the sides 22 as well as the center separation 30 in the sub-base 32 and raised central portion 34, contain matching elongated openings 44. These openings 44 receive the lips 42 of the partitions 40 on both ends and the bottom when the partitions 40 are positioned within the divider. Since the openings 44 are collateral with the extended lips 42, the simultaneous interlinking holds the partitions 40 tightly into place forming the dividing partition. This arrangement allows easy removal for making combination dividers for diversified drawing stacks, and also prevents the bottom-most drawings from sliding into adjacent compartments.

The various elements of the divider are fabricated of any type of material suitable for the purpose, such as laminated foam board, wood laminated with paper or cloth on each side, with cost effective corrugated single ply cardboard being preferred.

Figure 7:
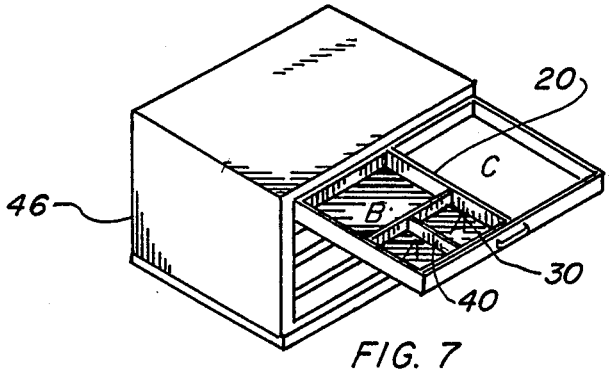
FIG. 7 is a partial isometric view of a small file cabinet with one divider installed in half of the drawer with drawing size depicted in each compartment by alphabet designation.
Figure 8:
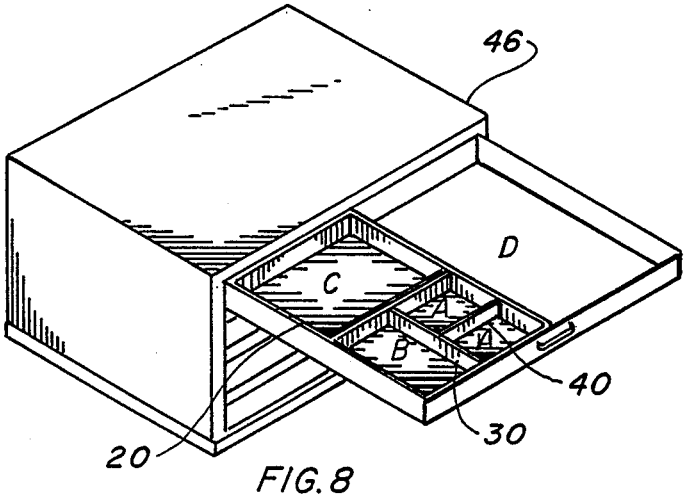
FIG. 8 is a partial isometric view of a medium size file cabinet with two dividers (50 in.×38.5 in. (127 cm×97.8 cm) installed in half of the drawer with drawing size depicted in each compartment by alphabet designation.
Figure 9:
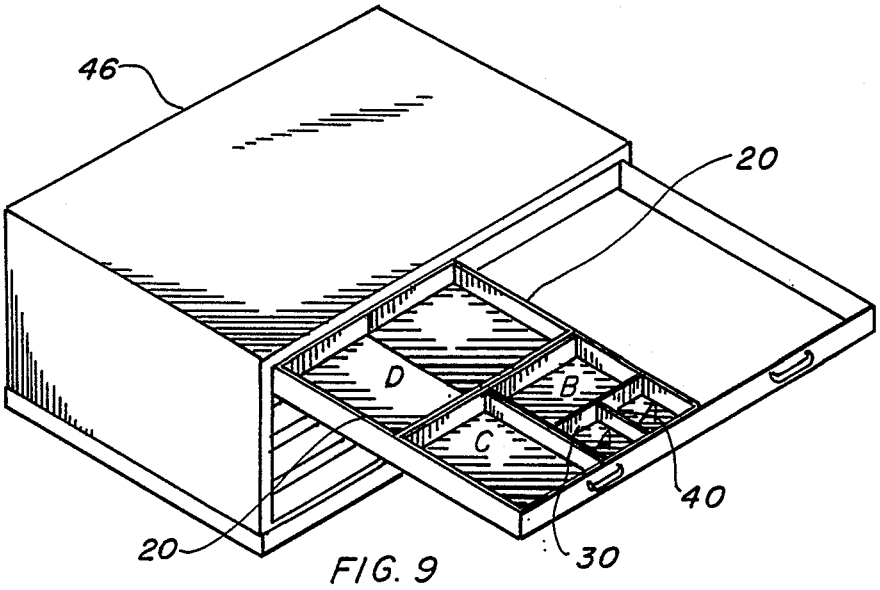
FIG. 9 is a partial isometric view of a large file cabinet with two dividers spliced together for D-size drawings and two separate dividers for A, B and C drawings, and the balance of the drawer for E-size drawings with drawing size depicted in each compartment by alphabet designation.

Since the partition 40 and center separation 30 are removable, the flexibility of the divider, as for the size and combination of drawings that may be stored, is uncompromising by using all or some of the divider components. As an example, FIGS. 7 through 9 illustrate three separate size state of the art file cabinets with multiple drawers 46. FIG. 7 illustrates a flat drawer file with the divider in place allowing A and B size drawings to be stored within, and the remaining space for C size drawings. FIG. 8 depicts a larger file 46 allowing a pair of dividers to be utilized storing A, B and C size drawings, with the balance for D size. FIG. 9 again depicts a flat drawer file of the largest size readily available on the commercial market which allows four separate dividers to be contiguously located for multiples of sizes, as above, and a pair of dividers modified by splicing the ends together and omitting the center separation 30 and partitions 40 providing a storage space for D size drawings, with the remainder of the drawer accepting E size originals. It will be seen that the combination of drawings stored may be easily varied, and since most drawers accommodate more than one size, the drawing storage cabinet drawer dividers would most likely be packaged and marketed in pairs. It will be noted that the dividers are purposely dimensioned to create a vacant space constituting a properly and perfectly dimensioned bin for other drawings or documents to be stored.

The assembly procedure is intuitively obvious as the dividers are scored, as depicted in the dashed lines of FIGS. 3 through 6, and the tabs 24, flaps 28 and ears 36 are easily aligned with the slots 26, corners and slits 38. The description of the end use is usually sufficient to indicate the assembly procedure and the flexibility of sizes, however, written instructions are easily accomplished. Assembly may be manually accomplished without tools and requires no particular skill on the part of the assembler.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. A divider for storing master drawings in drawers of a flat storage file cabinet comprising:

(a) a flat base having four sides of equal height with each side formed upwardly, inwardly, and downwardly into an interlocking contiguous juncture with said sides engaging said base defining an equal height borders on the base periphery;

(b) a center separation having a sub-base with a central portion thereof formed upwardly into a "U" shape, fitting snugly and contiguously within the base, such that the top of the central portion is planar relative to said base sides; and, (c) a plurality of partitions having a top and a bottom formed in "U" shape interlinked simultaneously into said flat base and center separation while concurrently interfacing with a base side on one end and the center separation central portion on the other with the partition in planar relationship with the base sides defining a plurality of individual and removable compartments within the divider for storing various sizes of said master drawings preventing the bottom-most master drawings from sliding into adjacent compartments and allowing order to be maintained within a storage file cabinet drawer.

2. The divider as recited in claim 1 wherein said interlocking contiguous juncture within the flat base of the divider further comprising; a plurality of tabs distending integrally from the periphery of the base sides and said flat base having a plurality of mating slots in alignment with the tabs defining said juncture when the tabs are positioned within the slots providing a permanent and rigid connection therebetween.

3. The divider as recited in claim 1 wherein the flat base further comprises opposed flaps on the sides allowing collateral communication with the flaps of opposite sides forming a structural corner when inserted between the upwardly and downwardly formed sides having sufficient integrity to hold each structured corner together integrally.

4. The divider as recited in claim 1 wherein the center separation of the drawer divider further comprises a pair of ears protruding outwardly from the upwardly extending central portion and two of said flat base sides having a slit aligned adjacently to said central portion of the center separation, such that each ear penetrates a slit in the side and project in opposite directions between the upwardly and downwardly formed base sides providing a permanent and rigid connection.

5. The divider as recited in claim 1 wherein the partitions of the drawer divider further comprises an extended lip on the ends and said flat base and said center separation having a plurality of elongated openings collateral with said extended lips defining the simultaneous interlinking of the particles into the base and the center separation.

6. The divider as recited in claim 1 further comprising folded cardboard as a basic material.

7. A divider assembled manually without tools requiring no skill on the part of the assembler for storing master drawings in drawers of a flat storage file cabinet comprising:

(a) a flat base having four sides of equal height with each side formed upwardly, inwardly, and downwardly into an interlocking contiguous juncture with side sides engaging said base defining an equal height border on the base periphery;

(b) a center separation having a sub-base with a center portion thereof formed upwardly into a "U" shape, fitting snugly and contiguously within the base, such that the top of the central portion is planar relative to said base sides; and, (c) a plurality of partitions having a top and a bottom formed in "U" shaper interlinked simultaneously into said flat base and center separation while concurrently interfacing with a base side on one end and the center separation central portion on the other with the partition in planar relationship with the base sides defining a plurality of individual and removable compartments within the divider for storing various sizes of said master drawings preventing the bottom-most master drawings from sliding into adjacent compartments and allowing order to be maintained within a storage file cabinet drawer and further allowing a varied and diverse configuration by using all or deleting some of the divider elements.

8. A divider assembled manually without tools for storing documents in drawers of a flat storage file cabinet comprising:

(a) a flat base having four sides of equal height with each side formed upwardly, inwardly, and downwardly, into an interlocking contiguous juncture with said sides engaging said base defining fining an equal height borders on the base periphery, the base size creating a vacant space in the drawer, and that this vacant space constitutes a properly and perfectly dimensioned bin for other documents to be stored;

(b) a center separation having a sub-base with a central portion thereof formed upwardly into a "U" shape, fitting snugly and contiguously within the base, such that the top of the central portion is planar relative to said base sides; and, (c) a plurality of partitions having a top and a bottom formed in "U" shape interlinked simultaneously into said flat base and center separation while concurrently interfacing with a base side on one end and the center separation central portion on the other with the partition in planar relationship with the base sides defining a plurality of individual and removable compartments within the divider for storing various sizes of said master drawings preventing the bottom-most master drawings from sliding into adjacent compartments and allowing order to be maintained within a storage file cabinet drawer.

* * * * *